US005970737A

United States Patent [19]

Downey

[11] Patent Number: 5,970,737

[45] Date of Patent: Oct. 26, 1999

[54] FREEZER PITCHER

[76] Inventor: Dawn A. Downey, 220 61st Ave. E., Bradenton, Fla. 34203

[21] Appl. No.: 09/149,827

[22] Filed: Sep. 8, 1998

[51] Int. Cl.[6] ..... F25D 3/08

[52] U.S. Cl. ..... 62/457.3; 62/457; 62/272

[58] Field of Search ..... 62/457.3, 272, 62/457

[56] References Cited

U.S. PATENT DOCUMENTS

| | | | |
|---|---|---|---|
| 3,715,895 | 2/1973 | Devlin | 62/457 |
| 4,357,809 | 11/1982 | Held et al. | 62/457 |
| 4,570,454 | 2/1986 | Campbell | 62/457 |
| 5,001,907 | 3/1991 | LaCroix et al. | 62/457.4 |
| 5,189,892 | 3/1993 | Roberts | 62/372 |
| 5,207,076 | 5/1993 | Sciarrillo | 62/457.4 |
| 5,406,808 | 4/1995 | Babb et al. | 62/457.4 |
| 5,573,141 | 11/1996 | Chen | 62/457.3 |
| 5,653,124 | 8/1997 | Weber | 62/457 |

*Primary Examiner*—Henry Bennett
*Assistant Examiner*—Mark Shulman
*Attorney, Agent, or Firm*—Joseph N. Breaux

[57] ABSTRACT

A freezer pitcher comprises a container having an open top with a generally annular interior wall and a generally annular exterior wall radially spaced apart to form a cavity therebetween. A freezable liquid is disposed within the cavity for maintaining the container at a cool temperature for a determinable time interval, so as to keep a beverage placed within the container cool. A structure is extendable from an annular base member on a bottom end of the container, for removing ice formed upon the exterior wall of the container.

4 Claims, 1 Drawing Sheet

FREEZER PITCHER

TECHNICAL FIELD

The present invention relates to cooling beverage containers and more particularly to a freezer pitcher. The freezer pitcher is a container having a double wall with a cavity therebetween into which a freezable liquid is positioned such that the freezable liquid can cool beer or other beverages placed within the beverage holding container. The exterior wall includes a plugged access opening for changing the freezable liquid within the cavity when needed. The base of the container includes a spring-loaded ice scraper which when extended will remove ice and frozen beverage from the exterior wall.

BACKGROUND ART

Numerous cooling beverage containers have been provided in prior art. For example, U.S. Pat. No. 4,357,809 to Held et al.; 5,001,907 to LaCroix et al.; 5,189,892 to Roberts; 5,207,076 to Sciarrillo; 5,406,808 to Babb et al. and 5,653,124 to Weber all are illustrative of such prior art. While these units may be suitable for the particular purpose to which they address, they would not be as suitable for the purposes of the present invention as heretofore described.

The Held et al. U.S. Pat. No. 4,357,809 discloses a cooling arrangement including a gel. The beverage cooling arrangement having an inner receptacle defined by a closed end, an open end and a wall disposed between the open and closed ends. An outer encasement partially encases the inner receptacle, and the encasement is joined at the upper end to the inner receptacle along the open end thereof forming a cavity between the inner receptacle and the encasement. A layer of cellular compressible heat-insulating material is disposed within the cavity adjacent the encasement. A solid gel refrigerant is disposed within the remainder of the cavity between the insulation layer and the receptacle. A base is secured to the outer encasement so as to completely seal and isolate the cavity from the outside environment.

The LaCroix et al. U.S. Pat. No. 5,001,907 discloses a beverage container with refrigerant gel. The beverage container includes an inner tubular wall defining a reservoir; a transparent outer tubular wall surrounding the inner wall and spaced therefrom to form an annular chamber having upper and lower annular openings; a top wall joining upper ends of the inner and outer walls and closing the upper opening; a base closing the lower opening; and a refrigerant gel retained within the chamber.

The Roberts U.S. Pat. No. 5,189,892 discloses a container that cools liquids. The container that keeps liquids cold includes an upstanding hollow post that defines an upstanding cavity having an open end at the lowermost end of the container. A frozen plug is inserted into the cavity from the lowermost end and locked into place. The hollow post is made of a non-insulating material, so that the cold plug lowers the temperature of the liquid in the container or reduces the rate of temperature increase of the liquid. The plug need not be maintained in a clean condition because it never comes into contact with the liquid in the container.

The Sciarrillo U.S. Pat. No. 5,207,076 discloses a pitcher cooler. The present invention comprises an apparatus for cooling liquid held in a vessel having an externally extending handle. The apparatus comprises a double-walled container having an inner wall and an outer wall radially spaced apart. The inner wall and outer wall are sealingly attached to a generally flat base member. Each of the inner and outer walls extend generally arcuately about the base member and defines a slot extending substantially perpendicular from the base member. The ends of the inner wall are sealingly connected to the ends of the outer wall adjacent the slot and edges of the inner and outer walls distal from the base member are sealingly attached one to the other for defining a closed space between the inner and outer walls. A refrigerant coolant is disposed in the closed space for maintaining the container at a predeterminately cool temperature for a determinable time interval. The vessel is removably positionable in the container with the handle extending through the slot.

The Babb et al. U.S. Pat. No. 5,406,808 discloses a two-liter bottle cooler/insulator. The two-liter bottle cooler includes a container and a lid. The container has a chamber with an enclosed bottom and an open top. The container has multiple walls displaced from each other creating annular pockets. The annular pocket that is nearest the chamber is filled with a freeze gel and the outer annular pocket is filled with an insulating foam. The open top of the container has external threads and the mouth of the lid is internally threaded with mating threads. The lid can be screwed onto the container to hold a two-liter bottle in place within the chamber. The dome of the lid has a hole with the neck of the two-liter bottle passing through the hole, so that beverage contained within the two-liter bottle can be poured directly from the bottle as it is held in the cooler. The hole in the dome is internally threaded, so that the cooler can also function as a container without an inserted two-liter bottle. In the latter case, a pour spout is provided with a threaded plug and a spout. The threaded plug mates with the internal threading in the hole of the dome to close the dome. The spout is externally threaded and a two-liter bottle cap can be threaded onto the spout to close it. When the pour spout is not in use, it can be stored in a pocket in the handle in the cooler. The pocket is internally threaded to mate with the external threads on the plug. When the plug is in use, the cover can be stored by threading it onto an externally threaded stump contained on the bottom of the handle of the cooler.

The Weber U.S. Pat. No. 5,653,124 discloses a refrigerated insulating beverage container system. An insulated stein for carrying and maintaining a constant temperature of a poured beverage or of a canned beverage, featuring a sleeve to slip the can into, an optional insulating vessel to alternatively slip into the sleeve that can by itself contain a beverage poured into the vessel, a D-handle for the user to grasp onto, a hinged lid that can be pivoted upwards or downwards to cover the top of the can or to make the can accessible to the user, and a portable reusable refrigerant disk that fits into a cavity in the bottom of the stein and is held in place by a fitted bottom cap. The stein is made of an injection molded thermoplastic selected for good insulating properties.

GENERAL SUMMARY DISCUSSION OF INVENTION

The freezer pitcher consists of a structure that is fabricated in such a way, whereby a cavity between two walls has the capability of holding a freezable liquid which keeps the beverage stored in it cool for drinking pleasure. The exterior wall has a plug so that freezable liquids can be interchanged for more appeal. The freezer pitcher has a spring-retractable cord with the end having a small ice scraper to remove ice which may form on the surface of the exterior wall of the container while in use. When finished with the ice scraper, it will retract back via the spring-loaded mechanism and slide into its locked position.

A primary object of the present invention is to provide a freezer pitcher that will overcome the shortcomings of the prior art devices.

Another object is to provide a freezer pitcher that will be capable of keeping a stored refreshment, such as a beer or other beverage, cool by way of a pre-chilled freezable liquid inside a cavity between two walls thereof.

An additional object is to provide a freezer pitcher that can be used in a bar, restaurant or the home for serving beverages cold, whereupon the freezable liquid when thawing out will not dilute the beverage therein or damage furniture the freezer pitcher is placed on.

A further object is to provide a freezer pitcher that is simple and easy to use.

A still further object is to provide a freezer pitcher that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
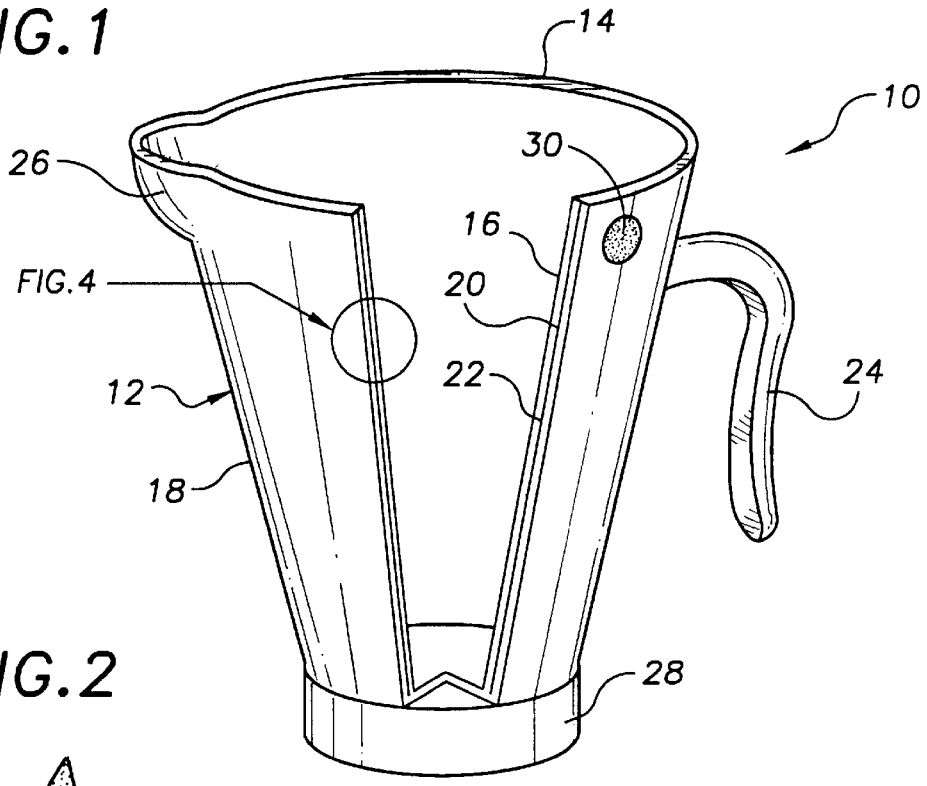
FIG. 1 is a diagrammatic perspective view of the present invention partly broken away.

Turning now descriptively to the drawings, in which similar reference characters denote similar elements throughout the several views, FIGS. 1 through 4 illustrate the various features of the present invention being a freezer pitcher 10 comprising a container 12 having an open top 14 with a generally annular interior wall 16 and a generally annular exterior wall 18 radially spaced apart to form a cavity 20 therebetween. A freezable liquid 22 is disposed within cavity 20 for maintaining container 12 at a cool temperature for a determinable time interval, so as to keep a beverage placed within container 12 cool.

Container 12 includes a handle 24 projecting outwardly from exterior wall 18 and a spout 26 formed at open top 14. A user can grasp handle 24 and pour the beverage out of container 12 via spout 26. An annular base member 28 is on a bottom end of container 12, so as to stabilize container 12 upon a horizontal support surface. Container 12 has a plugged access opening 30 in exterior wall 18 near open top 14, so that the freezable liquid 22 can be replaced when needed.

Figure 2:
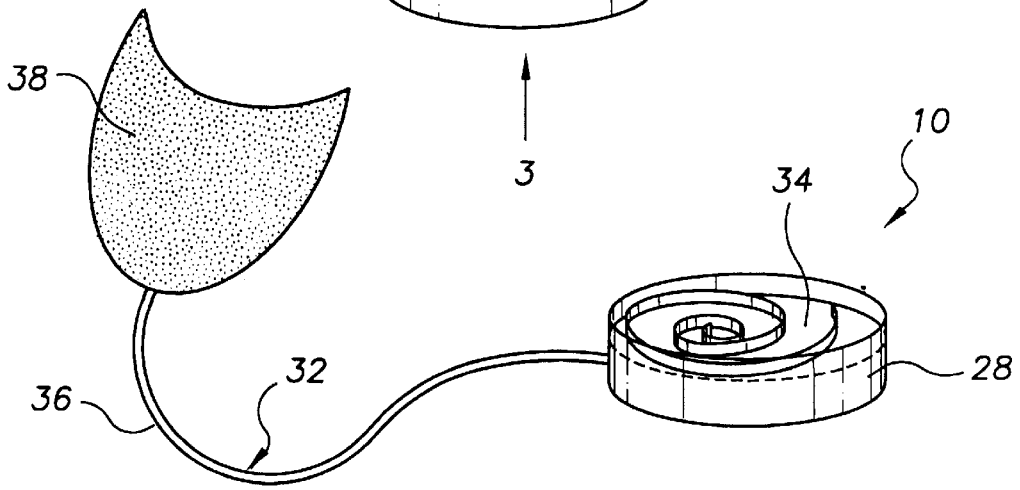
FIG. 2 is a diagrammatic perspective view of the annular base member showing the small ice scraper extended therefrom.
Figure 3:
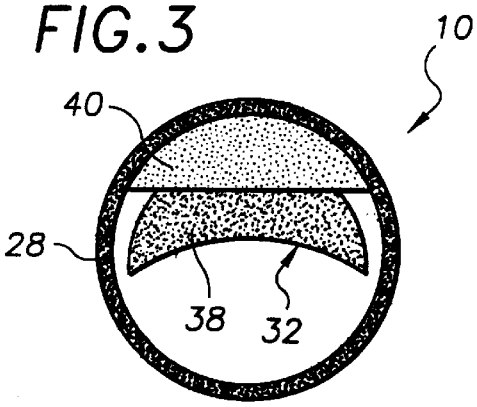
FIG. 3 is a bottom view of the annular base member taken in the direction of arrow 3 in FIG. 1.
Figure 4:
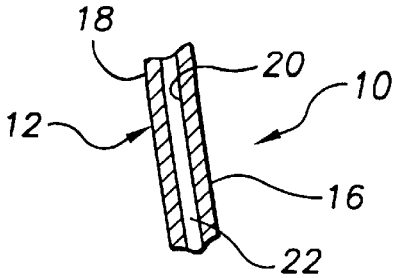
FIG. 4 is an enlarged area of the container as indicated by arrow 4 in FIG. 1.

A structure 32, best seen in FIG. 2, is extendable from annular base member 28 for removing ice formed upon exterior wall 18 of container 12. The ice removing structure 32 consists of a spring-loaded retrieval spool 34 mounted within annular base member 28. A retractable cord 36 extends from spring-loaded retrieval spool 34. Small ice scraper 38 is on a free end of retractable cord 36. An ice scraper catch 40, best seen in FIG. 3, is built into annular base member 28. When retractable cord 36 is automatically pulled back and wound about spring-loaded retrieval spool 34, the small ice scraper 38 will be locked into a stored position in ice scraper catch 40.

It can be seen from the preceding description that in use, a user will replace the standard beverage pitcher/container with freezer pitcher 10, which is placed in a freezer before use. In use, freezer pitcher 10 will hold a refreshing beverage and keep it cooler for longer periods of time. When the user wishes to change freezable liquid 22, the user pulls out the rubber plug from access opening 30, drains the fluid and replaces it with either another colored fluid and/or one with floating decorative icons, such as happy faces or any other conceivable forms. In the event ice builds up on exterior wall 18 of container 12, the user will reach into the bottom of annular base member 28 and remove small ice scraper 38 which is connected to retractable cord 36 attached to spring-loaded retrieval spool 34. When finished the cord 36 will automatically retract and the small ice scraper 38 will be locked back into its storage position in ice scraper catch 40.

It is noted that the embodiment of the freezer pitcher described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A freezer pitcher comprising:

a container having an open top with a generally annular interior wall and a generally annular exterior wall radially spaced apart to form a cavity therebetween;

a freezable liquid disposed within said cavity for maintaining said container at a cool temperature for a determinable time interval, so as to keep a beverage placed within said container cool; and an annular base member on a bottom end of said container, so a to stabilize said container upon a horizontal support surface;

said container having a plugged access opening in said exterior wall near said open top, so that said freezable liquid can be replaced when needed.

2. A freezer pitcher comprising:

a container having an open top with a generally annular interior wall and a generally annular exterior wall radially spaced apart to form a cavity therebetween;

a freezable liquid disposed within said cavity for maintaining said container at a cool temperature for a determinable time interval, so as to keep a beverage placed within said container cool;

an annular base member on a bottom end of said container, so as to stabilize said container upon a horizontal support surface; and means extendable from said annular base member for removing ice formed upon said exterior wall of said container.

3. The freezer pitcher as recited in claim 2, wherein:

said ice removing means includes a spring-loaded retrieval spool mounted within said annular base member, a retractable cord extending from said spring-loaded retrieval spool and a small ice scraper on a free end of said retractable cord.

4. The freezer pitcher as recited in claim 3, further includes an ice scraper catch built into said annular base member, so that when said retractable cord is automatically pulled back and wound about said spring-loaded retrieval spool, said small ice scraper will be locked into a stored position in said ice scraper catch.

* * * * *